US012766659B2

(12) United States Patent
Schneider et al.

(10) Patent No.: US 12,766,659 B2
(45) Date of Patent: Oct. 20, 2026

(54) TOOL HOLDER, PROCESSING TOOL, TOOL SPINDLE AND METHOD FOR PROCESSING OPTICAL WORK-PIECES

(71) Applicant: Schneider GmbH & Co. KG, Fronhausen (DE)

(72) Inventors: Gunter Schneider, Marburg (DE); Armin Donsbach, Bad Laasphe (DE); Hans-Joachim Link, Biedenkopf (DE)

(73) Assignee: Schneider GmbH & Co. KG, Fronhausen (DE)

( * ) Notice: Subject to any disclaimer, the term of this patent is extended or adjusted under 35 U.S.C. 154(b) by 527 days.

(21) Appl. No.: 18/019,926

(22) PCT Filed: Aug. 4, 2021

(86) PCT No.: PCT/EP2021/071750
§ 371 (c)(1),
(2) Date: Feb. 6, 2023

(87) PCT Pub. No.: WO2022/029168
PCT Pub. Date: Feb. 10, 2022

(65) Prior Publication Data

US 2023/0373052 A1 Nov. 23, 2023

(30) Foreign Application Priority Data

Aug. 7, 2020 (DE) ..... 10 2020 004 816.1
Dec. 17, 2020 (DE) ..... 10 2020 007 766.8

(51) Int. Cl.
*B24B 13/01* (2006.01)
*B24B 41/04* (2006.01)
(Continued)

(52) U.S. Cl.
CPC ..... *B24B 13/01* (2013.01); *B24B 41/04* (2013.01); *B24D 13/147* (2013.01); *B24D 13/20* (2013.01); *B24B 13/02* (2013.01)

(58) Field of Classification Search
CPC ..... B24B 13/00; B24B 13/01; B24B 13/012; B24B 13/02; B24B 41/04; B24B 45/00; B24D 13/147; B24D 13/20
(Continued)

(56) References Cited

U.S. PATENT DOCUMENTS 8,029,341 B2 10/2011 Belly et al.
8,267,743 B2 9/2012 Schneider et al.
(Continued)

FOREIGN PATENT DOCUMENTS

CN 101318304 A 12/2008
CN 109153102 A 1/2019
(Continued)

OTHER PUBLICATIONS

Invitation to Pay Additional Fees and, where Applicable, Protest Fee, for International Application No. PCT/EP2021/071750, mailed Oct. 29, 2021.
(Continued)

*Primary Examiner* — Brian D Keller
*Assistant Examiner* — Marcel T Dion
(74) *Attorney, Agent, or Firm* — Jason H. Vick; Amped IP LLC

(57) ABSTRACT

The present invention relates to a tool holder for a processing tool for processing optical workpieces with a holder head for receiving a processing tool and a holder body for fastening the tool holder to a tool spindle. According to the invention, it is provided that the holder head is annular with an annular rim and that at least two holding elements are arranged on the annular rim. The present invention relates
(Continued)

further to a processing tool for processing optical workpieces having receiving openings in its base body.

26 Claims, 12 Drawing Sheets

(51) Int. Cl.
*B24D 13/14* (2006.01)
*B24D 13/20* (2006.01)
*B24B 13/02* (2006.01)

(58) Field of Classification Search
USPC ..... 451/508, 514, 515
See application file for complete search history.

(56) References Cited

U.S. PATENT DOCUMENTS

| | | | | |
|---|---|---|---|---|
| 9,089,948 | B2 * | 7/2015 | Schafer | F02B 23/0663 |
| 2006/0199481 | A1 | 9/2006 | Urban et al. | |
| 2008/0305723 | A1 | 12/2008 | Philipps et al. | |
| 2010/0151773 | A1 * | 6/2010 | Leonhardt | B24B 13/02 451/283 |
| 2017/0246720 | A1 | 8/2017 | Wallendorf et al. | |
| 2018/0361534 | A1 | 12/2018 | Schneider et al. | |
| 2019/0126425 | A1 | 5/2019 | Schneider et al. | |
| 2019/0126432 | A1 | 5/2019 | Wallendorf et al. | |
| 2021/0016410 | A1 | 1/2021 | Geist et al. | |

FOREIGN PATENT DOCUMENTS

| | | | |
|---|---|---|---|
| CN | 109414795 | A | 3/2019 |
| DE | 102004062319 | B1 | 3/2006 |
| DE | 202009000790 | U1 | 3/2009 |
| DE | 102016112999 | A1 | 1/2018 |
| DE | 102019005084 | A1 | 1/2021 |
| EP | 1698432 | A2 | 9/2006 |
| EP | 3418000 | A1 | 12/2018 |

OTHER PUBLICATIONS

International Search Report for International Application No. PCT/EP2021/071750, mailed Dec. 20, 2021.
Written Opinion for International Application No. PCT/EP2021/071750, mailed Dec. 20, 2021.

* cited by examiner

TOOL HOLDER, PROCESSING TOOL, TOOL SPINDLE AND METHOD FOR PROCESSING OPTICAL WORK-PIECES

CROSS-REFERENCE TO RELATED APPLICATIONS

This application is a national stage application under 35 U.S.C. 371 of PCT Application No. PCT/EP2021/071750, having an international filing date of 4 Aug. 2021, which designated the United States, which PCT application claimed the benefit of German Patent Application No. 10 2020 004 816.1, filed 7 Aug. 2020 and German Patent Application No. 10 2020 007 766.8, filed 17 Dec. 2020, each of which are incorporated herein by reference in their entirety.

BACKGROUND

The present disclosure relates to a processing tool. The present disclosure further relates to a tool holder. The present disclosure further relates to a tool spindle, in particular with a tool holder received thereon, in particular with a tool holder received thereon which is equipped with a processing tool. Finally, the present disclosure relates to a method for processing optical workpieces and a method for mounting a processing tool on a tool holder.

A tool holder is known from DE 10 2004 062 319 B1. Another tool holder is known from EP 3 418 000 A1. Such tool holders regularly have a component and/or structure that is suitable for holding or receiving a processing tool.

SUMMARY

An object of the present disclosure is to make possible a particularly simple change of the processing tool.

The above object is solved by a processing tool, by a tool holder, by a tool spindle, by a method for processing optical workpieces or by a method for mounting a processing tool on a tool holder as disclosed herein.

An aspect of the present disclosure relates to a processing tool having a base body. The base body comprises spring elements, wherein the spring elements have legs that enclose a receiving opening, and/or the base body comprises receiving openings, which are preferably undercut, distributed on a circle. Preferably, in this way, the processing tool or its base body can be connected reversibly in a form-fitting manner to a holder head of a proposed tool holder.

A further aspect of the present disclosure, which can also be implemented independently, relates to a tool holder having a holder head. The holder head is annular with an annular rim and at least two retaining elements are arranged on the annular rim. The proposed tool holder is of simple structural design and has a holder head which can be connected reversibly in a form-fitting manner to a processing tool by means of its retaining elements.

A further aspect of the present disclosure, which can also be implemented independently, relates to a tool spindle with the proposed tool holder and/or processing tool. In this way, corresponding advantages can be achieved.

A further aspect of the present disclosure, which can also be implemented independently, relates to a method characterized in that a processing tool is used which is rigidly mounted on a tool holder. The method according to the disclosure permits better guidance and/or control of the processing tool, since any movable connection between the tool holder and the processing tool, for example in the form of a ball head, a rubber-elastic component or a flexure bearing, is dispensed with.

A further aspect of the present disclosure, which can also be implemented independently, relates to a method for mounting a processing tool on a tool holder, wherein the processing tool is pushed onto the tool holder, rotated on the tool holder until further rotational movement is blocked and pushing the processing tool further on the tool holder. In this way, an operator can fit or plug the processing tool onto the tool holder without requiring a free field of view for this purpose.

The processing tool according to the disclosure, preferably a polishing tool for optical surfaces, has a base body, an elastic intermediate layer and a polishing foil.

Preferably, the elastic intermediate layer has at least two parts, wherein a first, harder part of the intermediate layer adjoins the base body, while a second, softer part of the intermediate layer adjoins the first, harder part and is arranged directly below the polishing foil.

On the one hand, the processing tool according to the disclosure is characterized by a long service life, such that the processing tool preferably needs to be changed only about every four hours, i.e., preferably only once within a work shift of an operator. On the other hand, the processing tool according to the disclosure is characterized in that it is suitable as a universal tool for processing even extreme optical surfaces, in particular for processing the prescription surfaces of lenses with extreme geometry, in particular extreme diopters and curvatures, including convex curvatures.

A further aspect provides that now in a corresponding processing apparatus the change of the processing tools in case of wear or damage is not only possible manually, but especially preferably always carried out manually. This is in particular facilitated or made possible with the tool holder according to the disclosure.

The tool holder is characterized in particular in that a processing tool is rigidly held, i.e. that any moving and/or elastic parts between the tool holder and the processing tool, such as in particular a spherical head, rubber-elastic parts or flexure bearings, are dispensed with.

In other words, the necessary deflection of the processing tool according to the disclosure during the processing operation, in particular the polishing process, takes place preferably exclusively by means of the two-part elastic intermediate layer. Thus, the processing tool can be controlled and/or guided much more precisely during the processing operation than is known in the prior art.

Preferably, the tool holder is further characterized in that it is or can be firmly mounted on the spindle head of the polishing spindle and only the processing tool itself is manually exchanged in the event of wear or damage.

According to the disclosure, a change of the processing tool can be carried out easily and safely, on the other hand, the processing tool is firmly held on the tool holder in such a way that it does not detach from the tool holder during the processing operation, in particular the polishing process.

In particular, it was surprisingly found that the preferred dimensions of both the tool holder and the base body of the processing tool may contribute to meeting these two opposing requirements particularly well. Thus, an operator can perform a change of the processing tool quickly and safely even without a direct view of the tool holder and/or with limited accessibility to the tool holder, which is fixed on the spindle head of the tool spindle.

Finally, the construction of the tool holder and the base body of the processing tool is preferably characterized in that no additional components are required for securing the processing tool on the tool holder, so that a change of the processing tool by an operator can be carried out single-handedly.

A preferred embodiment provides that the retaining elements of the tool holder are in the form of retaining lugs with a head. This structure makes it particularly easy to connect a basic body of a processing tool firmly but reversibly to the tool holder.

Three, preferably four retaining elements are expediently provided to ensure a particularly firm hold of the basic body of the processing tool. For the same reason, the retaining elements are preferably arranged rotationally symmetrically.

It is expedient that the tool holder has a bellows at the holder body, at the free end of which a spindle flange is fastened for fixing the tool holder to a tool spindle.

A preferred embodiment of the spindle flange has a collar to which the free end of the bellows is fixed, and a spindle disk for fixing the spindle flange to the tool spindle.

Preferably, the spindle disk has at least two, preferably three or four recesses in which spring elements are arranged.

Preferably, the recesses are arranged rotationally symmetrically in the spindle disk to ensure a particularly firm hold of the spindle disk on the tool spindle.

The tool spindle has a spindle head, preferably with at least two studs, pins or bolts, in particular by means of which a tool holder can be firmly connected to the spindle head via a spindle flange of a spindle disk.

A tool holder is preferably fastened to the spindle head in such a way that the at least two bolts are held positively or in form-fitting manner in the at least two receiving openings.

The processing tool is held on the tool holder in such a way that the spring elements are pushed onto the annular holder head of the tool holder, that the heads of the retaining elements are held positively or in form-fitting manner in the receiving openings of the spring elements.

As a result, a structurally simple, stable and joint-free or rigid connection of the processing tool to the spindle head of the tool spindle is obtained via the tool holder. Furthermore, the processing tool can be mounted or plugged on the tool holder in a simple manner and removed or pulled off again when the tool is changed.

The aforementioned aspects and features as well as the aspects and features of the present disclosure resulting from the claims and the following description can in principle be realized independently of each other, but also in any combination.

BRIEF DESCRIPTION OF THE DRAWINGS

An exemplary embodiment of the present disclosure is described in more detail below with reference to the accompanying drawings. It shows in schematic, not to scale representation.

DETAILED DESCRIPTION

In the figures, some of which are not to scale and are merely schematic, the same reference signs are used for the same, similar or alike parts and components, wherein corresponding or comparable properties and advantages are achieved, even if a repeated description is omitted.

Figure 1A:
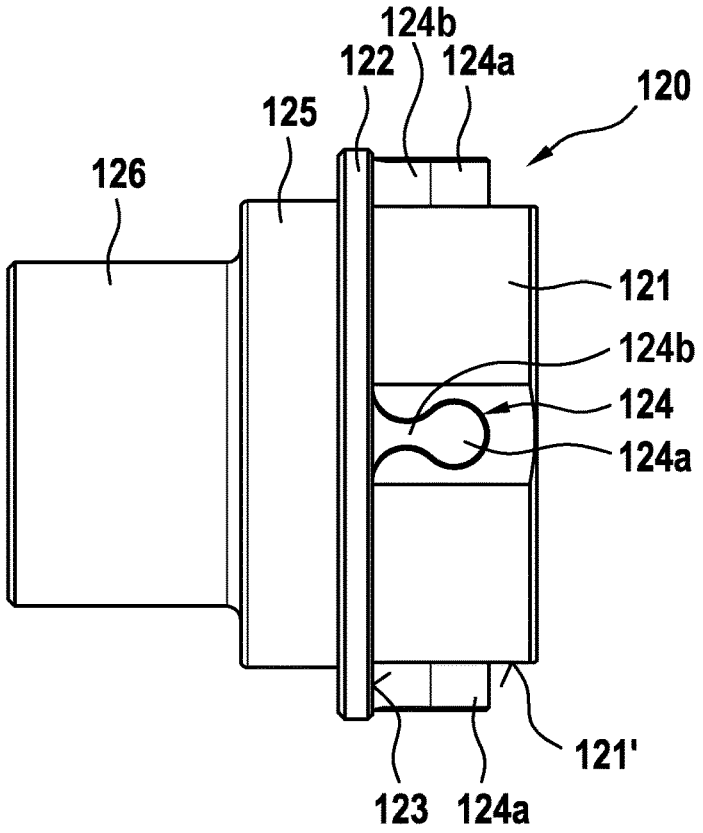
FIG. 1A a side view of an exemplary embodiment of a tool holder according to the disclosure.
Figure 1B:
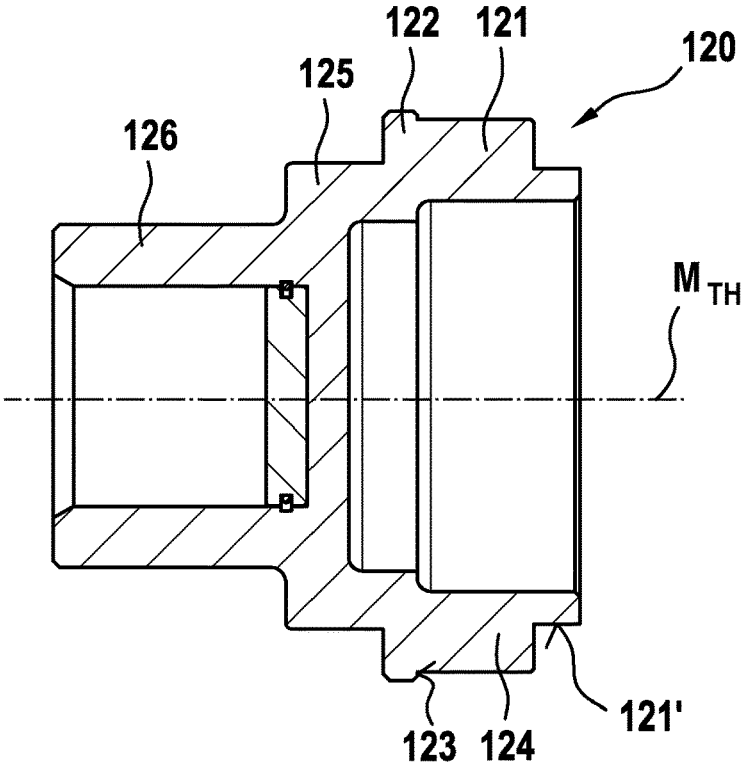
FIG. 1B a longitudinal section through the tool holder according to FIG. 1A.
Figure 1C:
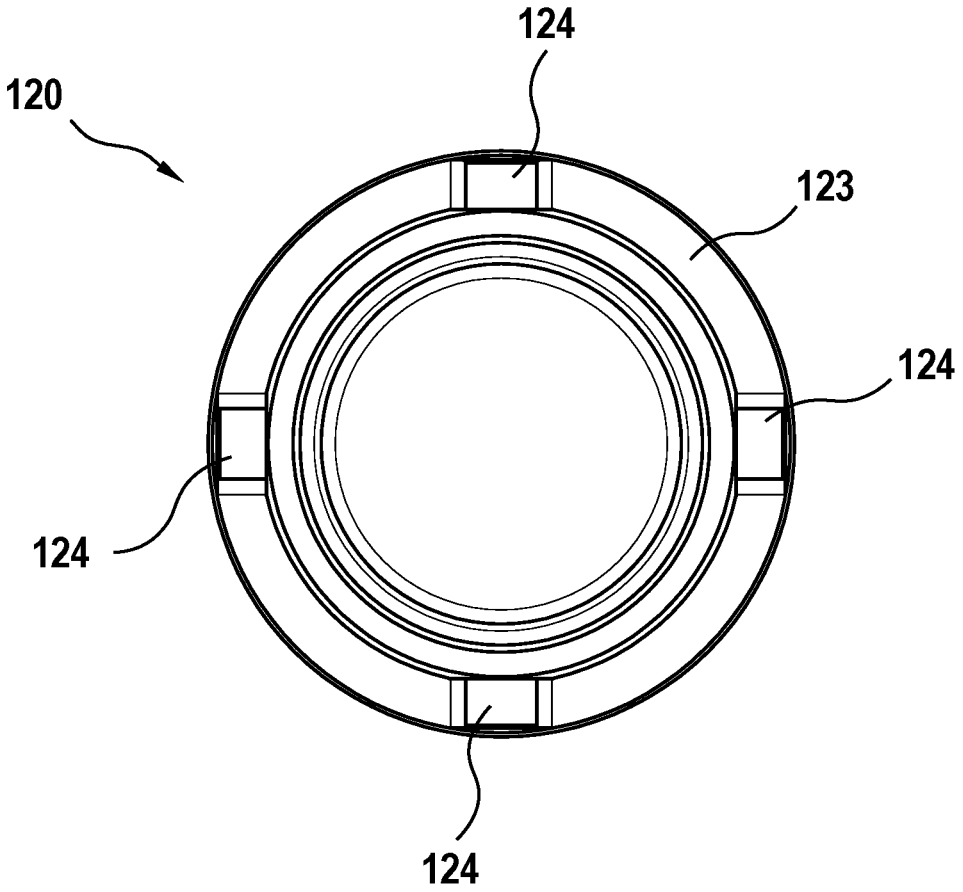
FIG. 1C a schematic front view of the tool holder.

FIGS. 1A, 1B and 1C show an exemplary embodiment of a tool holder 120 according to the disclosure.

The tool holder 120, which is preferably formed integrally or as one piece, consists in the exemplary embodiment preferably of an injection-molded plastic. A suitable plastic is, for example, PA 6.6 GF30 (polyamide made from hexamethylenediamine and adipic acid (nylon) with a glass fiber content of 30% by weight).

The tool holder 120 has an annular holder head 121, preferably centered on a collar 122.

Preferably, a substantially cylindrical extension 125 joins on the side of the collar 122 facing away from the holder head 121, which extension 125 preferably merges into an annular holder body 126.

The tool holder 120, holder head 121, collar 122, extension 125 and/or holder body 126 are/is preferably at least essentially cylindrical and/or rotationally symmetric. In particular, the holder head 121, collar 122, extension 125 and/or holder body 126 are arranged concentrically to each other and/or have the same center axis or symmetry axis, which in particular also forms the symmetry axis or center axis $M_{TH}$ of the tool holder 120.

The symmetry axis or center axis $M_{TH}$ of the tool holder 120 preferably also forms the rotation axis around which the tool holder 120 is rotated during processing, in particular polishing, of an optical workpiece 9.

The tool holder 120, holder head 121 and/or collar 122 preferably comprises or forms an annular rim 123.

The collar 122 and/or annular rim 123 is preferably arranged between the holder head 121, on the one side, and the cylindrical extension 125 or holder body 126, on the other side.

Preferably, the annular rim 123 is or forms an axial face and/or extends in radial direction (with respect to the center axis $M_{TH}$). In particular, the annular rim 123 faces in axial direction and/or towards the holder head 121 and/or away from the extension 125 or holder body 126 and/or, during processing, towards a processing tool 320 or the optical workpiece 9 and/or away from a tool spindle 30, 30'.

The holder head 121 preferably comprises or forms an in particular annular outer wall 121'. The outer wall 121' preferably extends in axial direction and/or forms a radial face of the tool holder 120 or holder head 121.

The annular rim 123 and outer wall 121' are preferably at least essentially perpendicular to each other.

The annular rim 123 is preferably spaced apart from an axial end face of the tool holder 120 or holder head 121 or wall 121', preferably by more than 5 mm or 10 mm and/or less than 20 mm or 15 mm, in particular about 12 mm.

The diameter of the collar 122 is larger than the outer diameter of the holder head 121.

The annular rim 123 is preferably formed by or results due to the different diameters of the holder head 121 and collar 122.

Preferably, the diameter of the collar 122 and/or the outer diameter of the annular rim 123 is more than 30 mm or 35 mm and/or less than 50 mm or 45 mm, in particular about 41.5 mm or 40.25 mm.

Preferably, the outer diameter of the holder head 121 or its wall 121' and/or the inner diameter of the annular rim 123 is more than 25 mm or 30 mm and/or less than 40 mm or 35 mm, in particular about 33 mm or 33.2 mm.

Preferably, at least two retaining elements 124 are arranged on the holder head 121, wall 121' and/or annular rim 123, in particular integrally formed with the annular rim 123 and/or the outer wall 121'.

The retaining elements 124 preferably extend in axial direction (with respect to the center axis $M_{TH}$) and/or away from the annular rim 123 and/or along the outer wall 121'.

The retaining elements 124 are preferably at least essentially perpendicular to the annular rim 123 or collar 122.

The retaining elements 124 are preferably arranged (rotationally) symmetrically on the annular rim 123 or on/along a circle, said circle in particular being formed by the annular rim 123.

In the exemplary embodiment shown in the figures, four retaining elements 124, each spaced 90° apart, are integrally formed on the resulting annular rim 123 and are integrally connected to the outer wall 121' of the holder head 121.

Each retaining element 124 has a preferably substantially round head **124*a*, at least in circumferential/tangential and/or axial direction of the tool holder 120**.

The head **124*a* is preferably formed as a disk, in particular with a circular face of the disk facing in radial direction of the tool holder 120**.

Preferably, the retaining elements 124 are formed as retaining lugs.

Each retaining element 124 preferably has or forms an undercut and/or has a portion **124*b* which is thinner or has a smaller width than the head 124*a*, in particular thinner/smaller in the circumferential/tangential direction of the tool holder 120**.

In particular, the retaining element 124 tapers from the head **124*a* towards the thinned portion 124*b*. Preferably, the retaining element 124 then widens again towards the annular rim 123. However, it is also possible that the retaining element 124 tapers until it reaches or merges with the annular rim 123 or that it tapers into the thinned portion 124*b* and then has constant width until reaching or merging with the annular rim 123**.

Preferably, the head **124*a* and thinner portion 124*b* have the same thickness in radial direction of the tool holder 120**.

The height or extension in axial direction (with respect to the center axis $M_{TH}$ of the tool holder 120 or holder head 121) of each retaining element 124 is preferably more than 6 mm and/or less than 12 mm.

The width/thickness or extension in radial direction (with respect to the center axis $M_{TH}$ of the tool holder 120 or holder head 121) of the annular rim 123 and/or each retaining element 124 is preferably more than 4 mm and/or less than 10 mm, particularly preferably about 7 mm or 7.05 mm.

The length/width or extension in circumferential/tangential direction (with respect to the center axis $M_{TH}$ of the tool holder 120 or holder head 121) of each retaining element 124 and/or the diameter of the head **124*a*** is preferably more than 3 mm and/or less than 7 mm, in particular about 5 mm.

According to the disclosure, a manual change of the processing tool 320 should be easy and safe to perform, on the other hand, the processing tool 320 should be firmly held on the tool holder 120 in such a way that it does not detach from the tool holder 120 during the processing operation, in particular the polishing operation.

Surprisingly, it has now been found that the preferred dimensions of the tool holder 120, in particular as described above in interaction with the preferred dimensions of the processing tool 320 (see below for this), contribute significantly to meeting these two opposing requirements particularly well. This is to the extent that no additional components are required to secure the processing tool 320 on the tool holder 120, so that a change of the processing tool 320 by an operator can also be performed single-handedly.

The preferred dimensions of the tool holder 120—in interaction with the preferred dimensions of the processing tool 320 (see below)—further have the effect that an operator can carry out a change of the processing tool 320 quickly and safely even without a direct view of the tool holder 120 and/or in the case of limited accessibility of the tool holder 120, which is fixed on a spindle head 310 of a tool spindle 30, 30' (cf. FIGS. 1F, 1G).

Figure 1D:
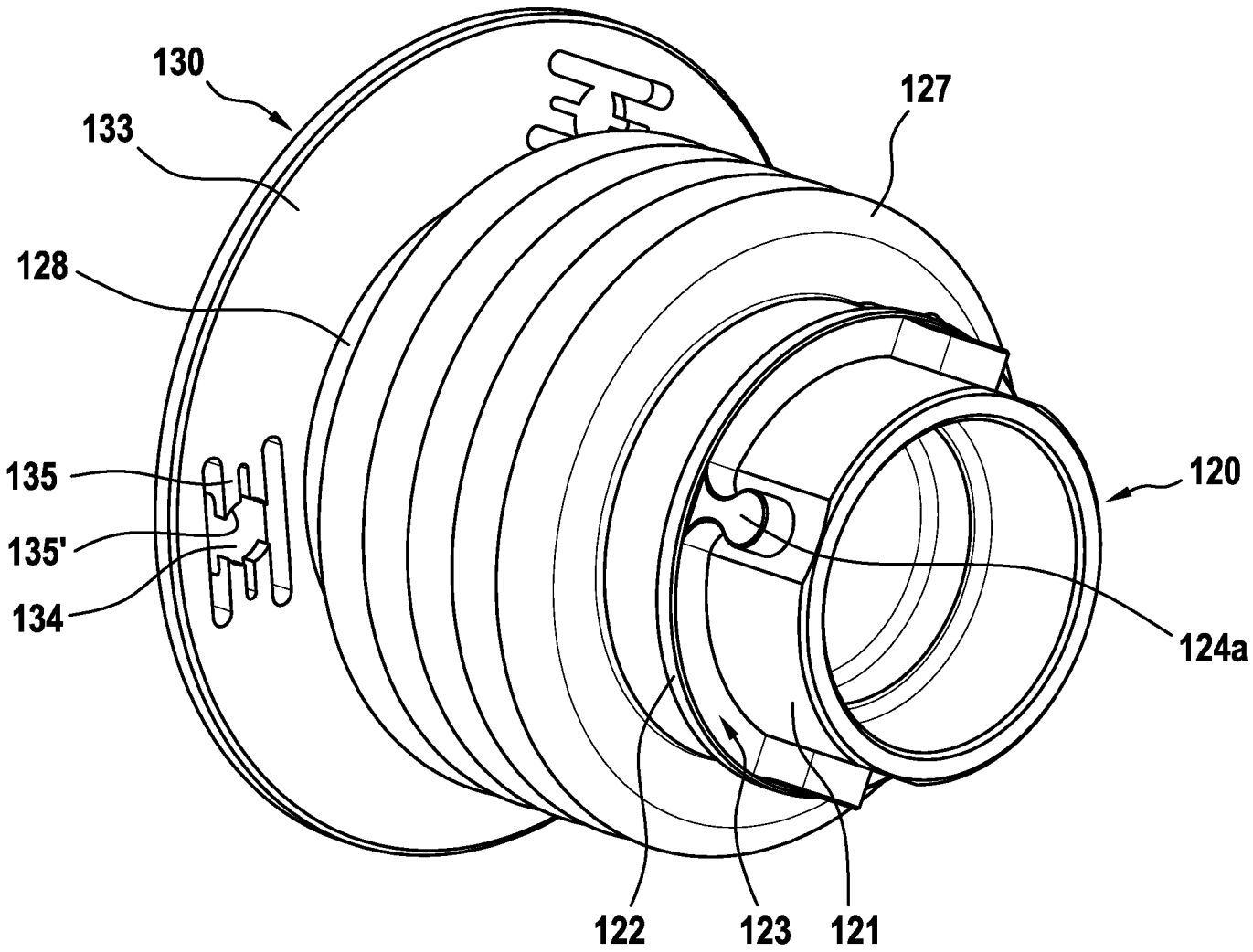
FIG. 1D the tool holder according to FIG. 1A with bellows and spindle flange.
Figure 1E:
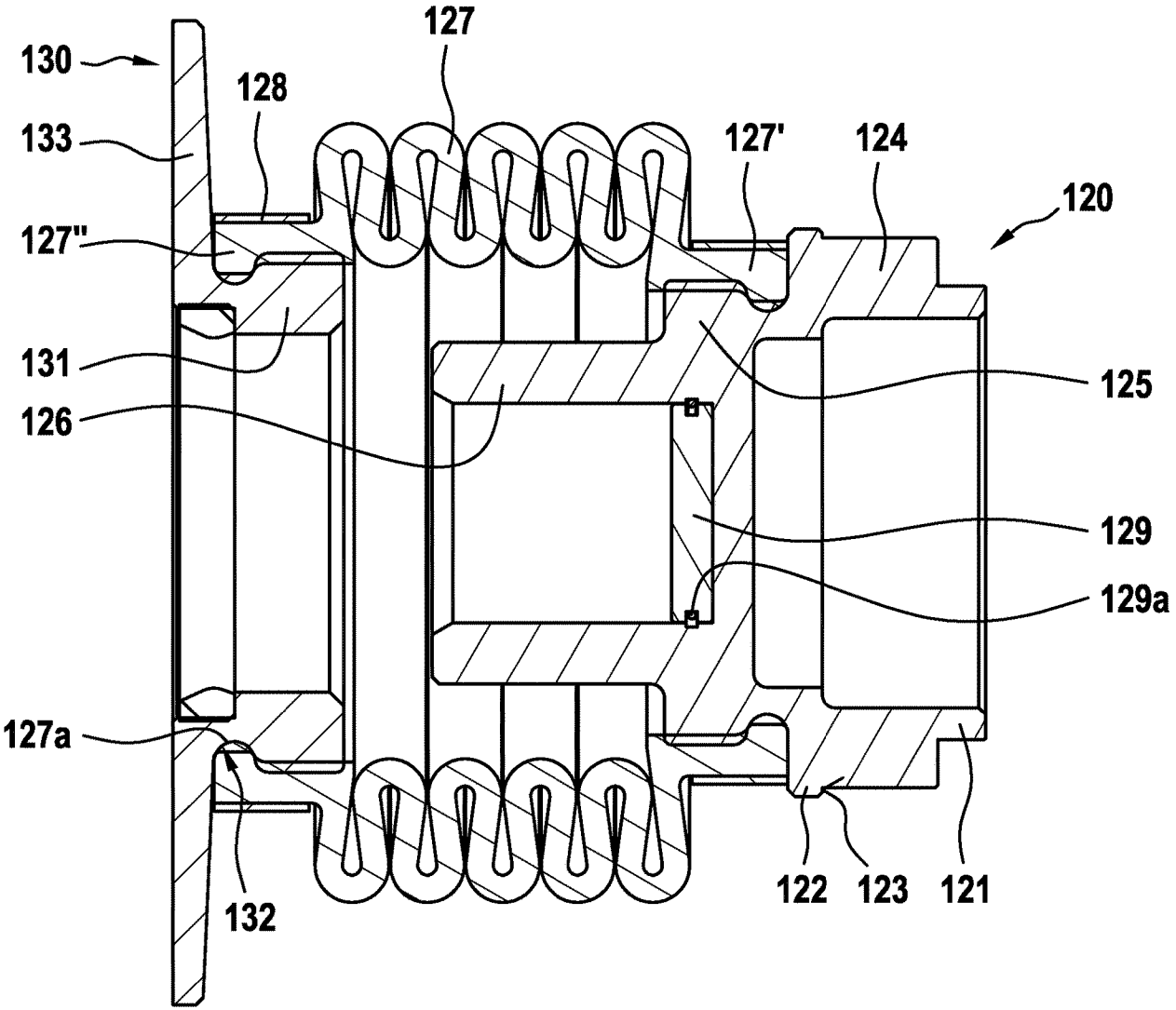
FIG. 1E a longitudinal section through the tool holder with bellows and spindle flange according to FIG. 1D.

FIGS. 1D and 1E show the tool holder 120 in an embodiment ready for use, with a bellows 127, preferably made of a vulcanized rubber, and a spindle flange 130.

A first free end 127' of a conventional bellows 127 is vulcanized onto the cylindrical extension 125 in a manner known per se.

The second free end 127" of the bellows 127 is fixed to a collar 131 of the spindle flange 130 by means of a clip or clamp 128.

When the second free end 127" is pulled onto the collar 131, the material of the bellows 127 is stretched so that the second free end 127" of the bellows 127 is firmly seated on the collar 131. The clamp 128 serves as an additional securing means of the resulting force-fit connection.

In FIG. 1E, it can be seen that an inner circumferential bead **127*a* is formed on the second free end 127" of the bellows 127 and that the bead 127*a* engages in an annular circumferential indentation 132 behind the collar 131, resulting in an additional form fit between the bellows 127 and the spindle flange 130**.

FIG. 1E also shows that an internal disk 129 is held clamped in the holder body 126 of the tool holder 120 by means of an annular spring **129*a*. The disk 129** consists of a metallic material that can be attracted by a magnet.

The spindle flange 130 is also injection molded in one piece and consists in the exemplary embodiment of the same material as the tool holder 120.

The spindle flange 130 further has an annular spindle disk 133 which adjoins the indentation 132.

The spindle disk 133 has a substantially larger outer diameter than the collar 131.

Three recesses 134 are rotationally symmetrically formed in the spindle disk 133, each at a distance of 120°. Each recess 134 has two opposing pairs of spring elements 135.

The free ends 135' of the spring elements 135 form an approximately circular outline.

Figure 1F:
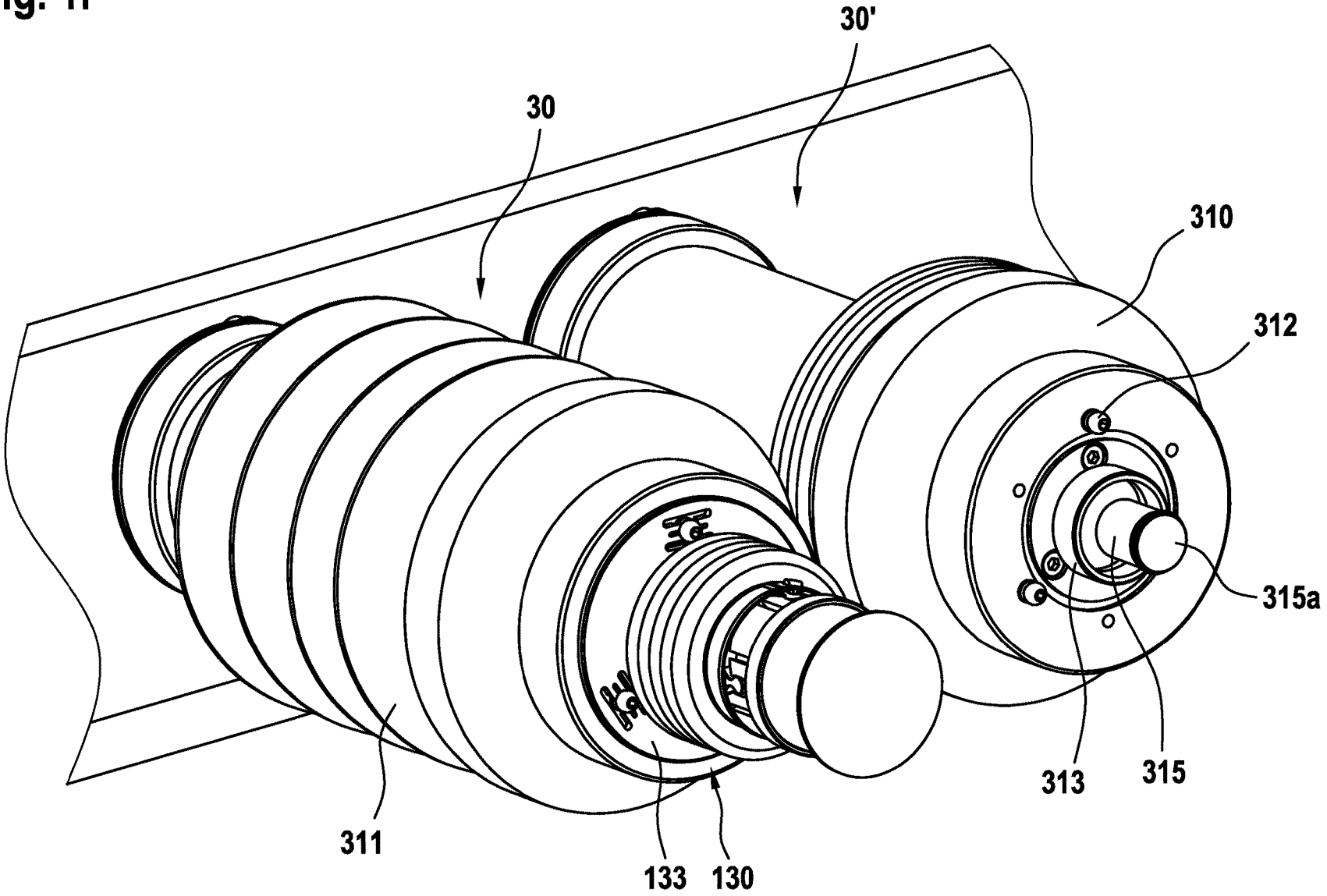
FIG. 1F a perspective view of a tool spindles pair with and without a processing tool.
Figure 1G:
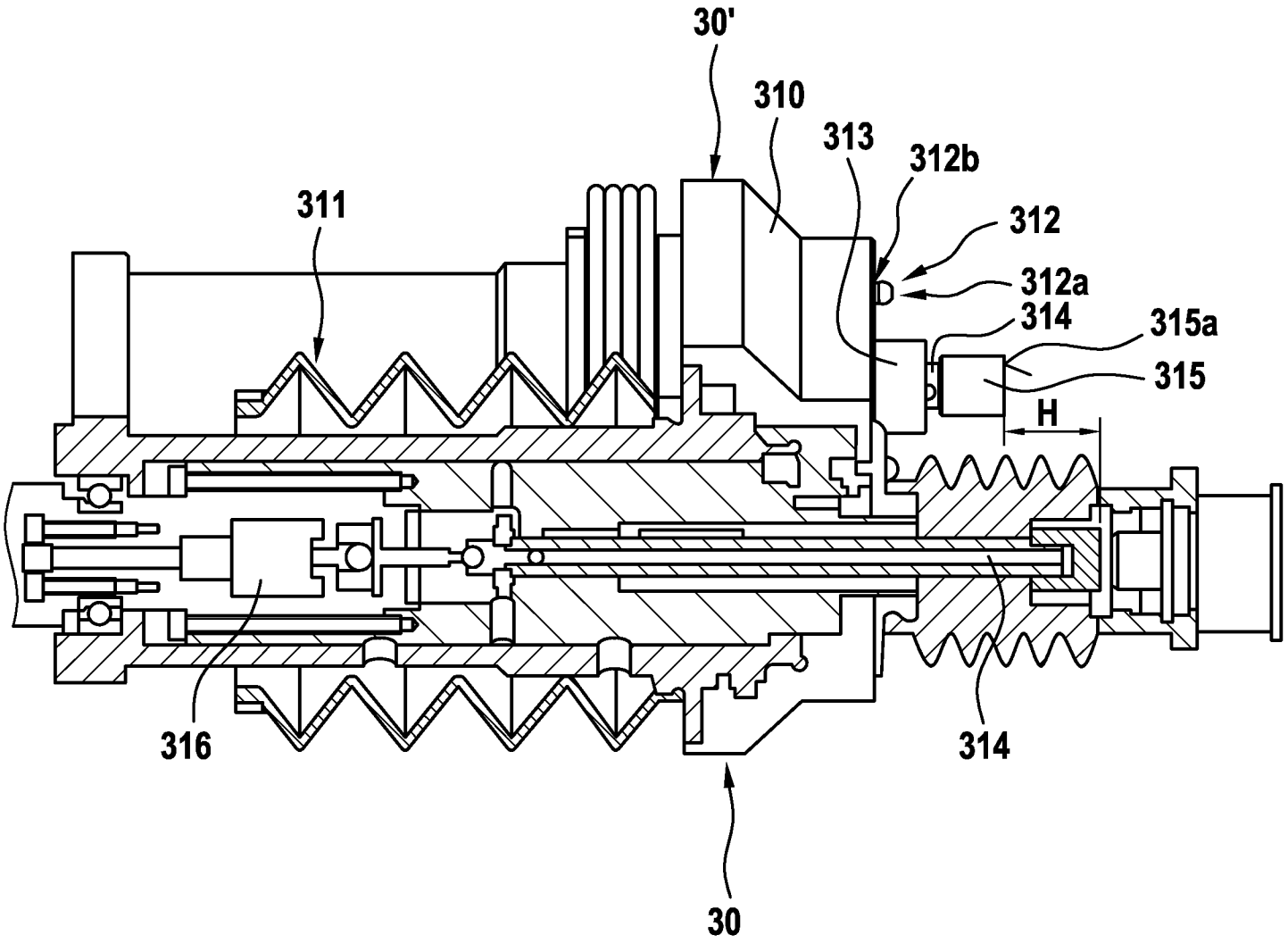
FIG. 1G a longitudinal section through the polishing spindle according to FIG. 1F with processing tool.

FIGS. 1F and 1G show two tool spindles 30, 30'.

It can be seen from FIGS. 1F and 1G that in each tool spindle 30, 30' a lifting rod 314 is mounted in a spindle shaft 313 in a manner known per se, in such a way that the lifting rod 314 is arranged movably in the direction of the Z-axis of an apparatus for processing optical workpieces 9.

For this purpose, a lifting cylinder 316 is provided in each tool spindle 30, 30', in a manner known per se, which cylinder in the exemplary embodiment operates pneumatically and is operatively connected to the lifting rod 314.

FIGS. 1F and 1G further show that both the spindle shaft 313 and the lifting rod 314 protrude from the spindle head 310.

The lifting rod 314 serves in a manner known per se for an oscillating infeed or movement of the processing tool 320 received on each tool spindle 30, 30' to the optical workpiece 9 during the processing.

The spindle head 310 covering the free end of the tool spindles 30, 30' is connected in the usual manner to a bellows 311.

The plate-shaped free end of the spindle head 310 has three studs or pins or bolts 312, which are arranged rotationally symmetrically to one another at a distance of 120°, respectively. The bolts 312 have a bolt head 312*a* and an annular recess 312*b* located behind it.

A cap 315 is screwed onto the lifting rod 314 in a manner known per se, the free surface 315*a* of which is formed as a magnet (cf. EP 3 418 000 A1, the disclosure of which is expressly referred to).

FIG. 1F shows how the spindle disk 133 of the spindle flange 130 is fixed to the spindle head 310. The bolts 312 are guided through the recesses 134 made in the spindle disk 133. In the process, the spring elements 135 are bent up in the direction of the bellows 127 until each bolt head 312*a* passes through the corresponding recess. The spring elements 135 then snap back into their initial position and at the same time engage in the annular recess 312*b*, thus engaging behind the bolt head 312*a*. Thus, the spindle disk 133 of the spindle flange 130 is securely held on the spindle head 310.

In FIG. 1G it can be seen that when the spindle disk 133 is fixed to the spindle head 310, the lifting rod 314 with the cap 315 engages in the annular holder body 126 of the tool holder 120. In the process, the disk 129 is attracted by the magnet of the free surface 315*a* of the cap 315 until the two parts are connected to each other in a force-fitting manner. This facilitates the fixing of the spindle disk 133 to the spindle head 310 and contributes to a firm hold of the tool holder 120 on the tool spindle 30, 30'.

Figure 2A:
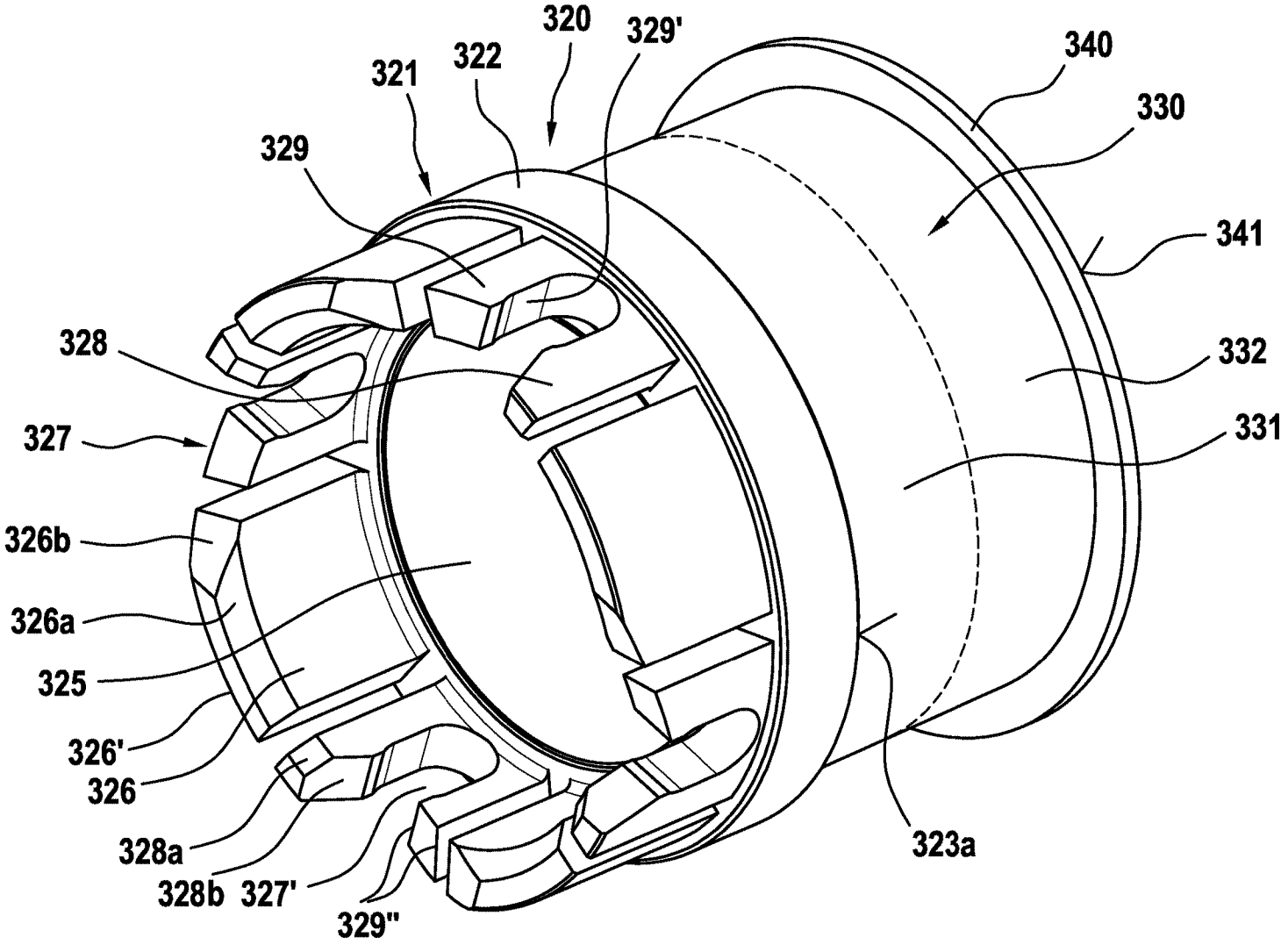
FIG. 2A a perspective view of an exemplary embodiment of a processing tool according to the disclosure.
Figure 2B:
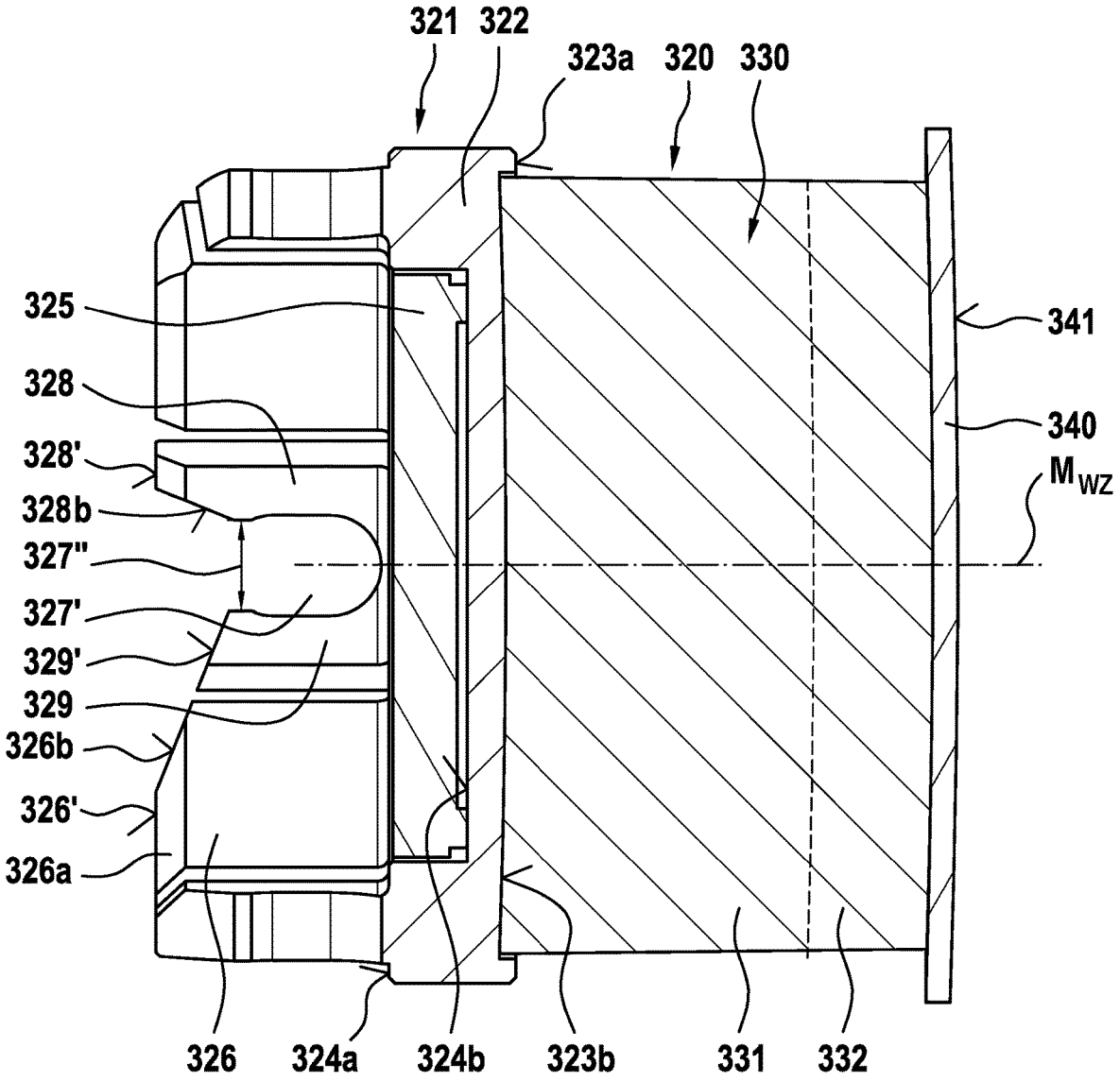
FIG. 2B a longitudinal section through the processing tool according to FIG. 2A.
Figure 2C:
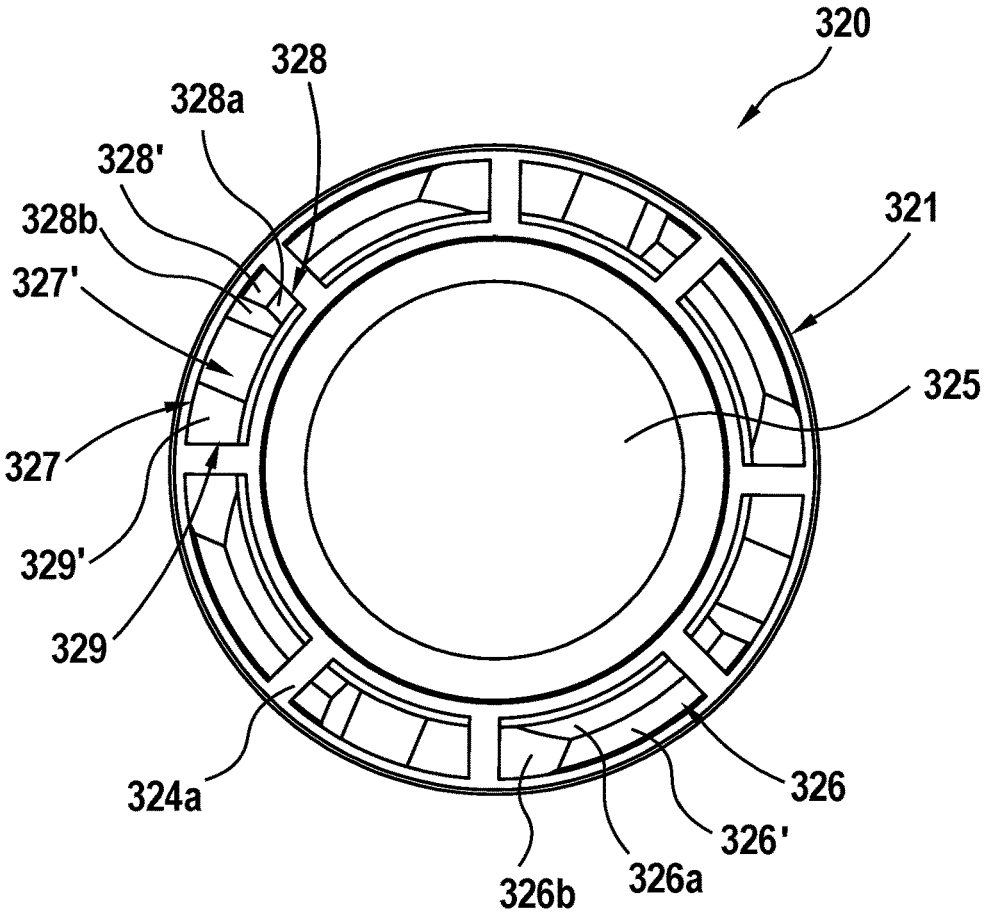
FIG. 2C a schematic front view of the base body of the processing tool.

In the exemplary embodiment, the tool spindles 30, 30' are equipped with a processing tool 320 according to FIGS. 2A to 2C.

In the exemplary embodiment, the processing tool 320 is a polishing tool 320 for polishing optical surfaces, in particular the prescription surfaces of lenses for eyeglass lenses.

In the exemplary embodiment, the polishing tool or processing tool 320 has a circular cylindrical rotational symmetry.

Figure 4A:
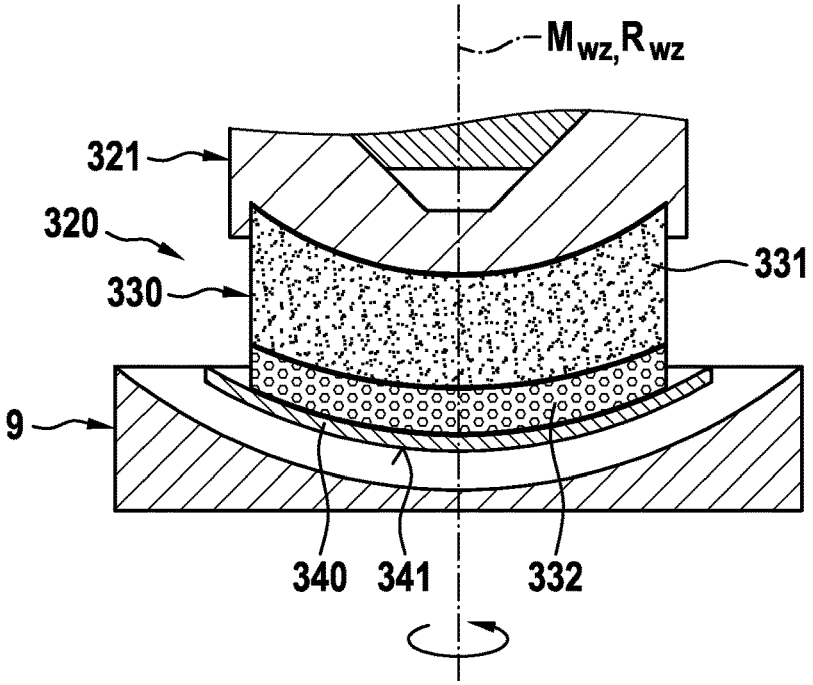
FIG. 4A a section through a processing tool and an assigned workpiece, wherein the processing tool is spaced from the workpiece.
Figure 4B:
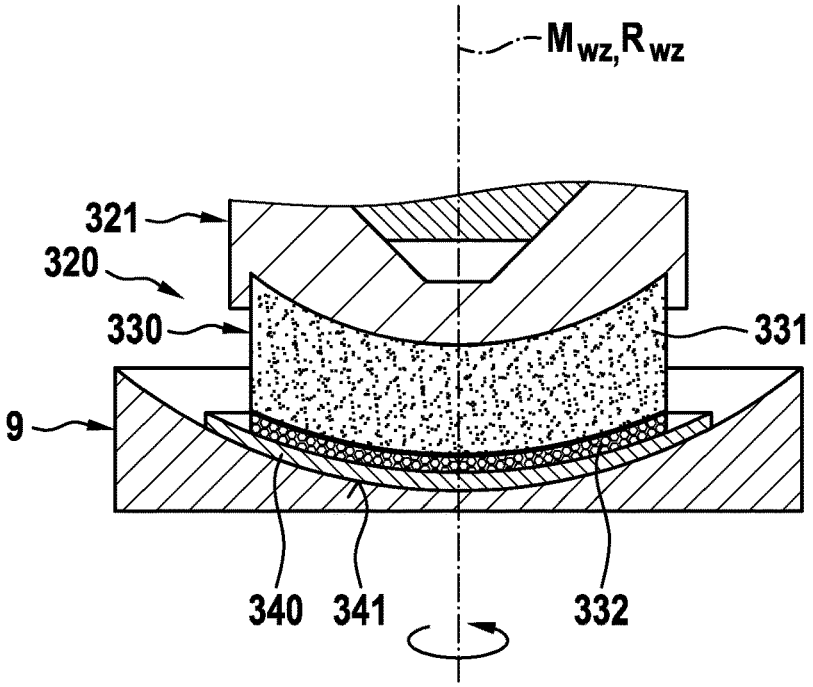
FIG. 4B a view according to FIG. 4A, wherein the processing tool is in a central processing position.
Figure 4C:
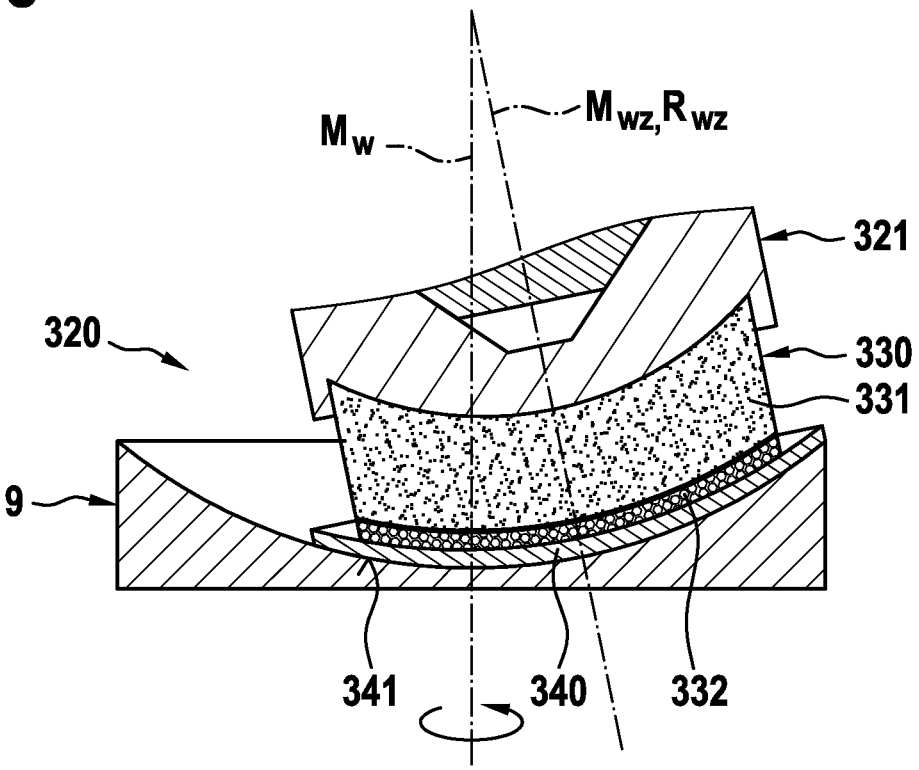
FIG. 4C a view according to FIG. 4B, wherein the processing tool is in an off-center processing position.

The processing tool 320 preferably has a symmetry axis or center axis $M_{WZ}$ (shown in FIGS. 4A to 4C).

The symmetry axis or center axis $M_{WZ}$ of the processing tool 320 preferably also forms the rotation axis $R_{WZ}$ around which the processing tool 320 is rotated during processing, in particular polishing, of an optical workpiece 9.

In the illustrated exemplary embodiment according to FIGS. 2A to 2C, the processing tool 320 has a base body 321 with a base plate 322, an intermediate layer 330 in the form of a foam carrier, and a polishing film or polishing foil 340.

In the exemplary embodiment, the base body 321 is rigid, but at least harder than the intermediate layer 330 and the polishing foil 340, in order to provide the polishing tool 320 with the necessary stability and to allow it to be fixed to the tool spindles 30, 30'. Suitable materials for the base body 321 are, for example, rigid PVC (uPVC) materials.

It is expedient that the base body 321 is preferably formed in one piece, for example injection molded.

The intermediate layer 330 is preferably received in a precisely or appropriately dimensioned recess 323*b* of the workpiece-side base surface 323*a* of the base plate 322. Preferably, the intermediate layer 330 is firmly connected to the base plate 322, in the exemplary embodiment glued or adhesively bonded.

In a manner known per se, the recess 323*b* has a defined spherical curvature which produces a corresponding deformation of the intermediate layer 330 and thus a corresponding spherical curvature of the polishing foil 340.

The radius of curvature of the recess 323*b* is preferably between 75 mm and 1,000 mm, typically between 150 mm and 600 mm.

Compared to the prior art, larger radii of curvature of the recess 323*b* have proven to be effective in order to be able to polish larger processing surfaces of the lenses and/or to increase the material removal during polishing.

Of course, both convex and concave curvatures (i.e., positive or negative radii of curvature) of recess 323*b* may be provided to allow optical workpieces 9 with concave or convex optical surfaces, respectively, to be processed.

In the exemplary embodiment, an RFID chip 325 is preferably embedded in a precisely or appropriately dimensioned recess 324*b* of the spindle-side base surface 324*a* of the base plate 322 and/or is firmly connected to the spindle-side base surface 324*a*, e.g. cast on or glued or adhesively bonded.

In the exemplary embodiment, an annular receiving and/or connecting region for receiving and/or centering the tool holder 120 and/or connecting therewith is formed on the spindle-side base surface 324*a* of the base body 321 or base plate 322 in the form of spring elements 326, 327.

Preferably, two different types of spring elements 326, 327 are provided.

In the exemplary embodiment shown in the figures, four spring elements 326 and four spring elements 327, preferably different from the spring elements 326, are provided.

In the exemplary embodiment, the spring elements 326, 327 are preferably in the form of spring tongues.

The spring elements 326, 327 preferably project or extend from the base body 321 or base plate 322 or spindle-side base surface 324*a*, in particular in axial direction (with respect to axis $M_{WZ}$) and/or away from the intermediate layer 320 or polishing foil 340 and/or, during processing, away from the optical workpiece 9 and/or towards the tool holder 120 or tool spindle 30, 30'.

Preferably, the spring elements 326, 327 form or comprise (axial) free ends 326', 328', 329', which face in particular away from the base body 321 or base plate 322 or intermediate layer 320 or polishing foil 340 and/or, during processing, away from the optical workpiece 9 and/or towards the tool holder 120 or tool spindle 30, 30'.

The spring elements 326, 327 are preferably distributed evenly on or along an (axial) annular face of the base body 321 or base plate 322 or spindle-side base surface 324*a*.

Preferably, the spring elements 326, 327 are arranged on or along a circle and/or form a ring-like structure.

Preferably, the spring elements 326 and spring elements 327 are arranged alternating. In particular, a spring element 326 is adjacent to two spring elements 327 and vice versa.

In the exemplary embodiment shown in the figures, in particular in FIG. 2C, the spring elements 326 are preferably at least essentially 90° apart and/or the the spring elements 327 are preferably at least essentially 90° apart.

Two adjacent spring elements 326, 327 are preferably at least essentially 45° apart.

The distance or gap between two adjacent spring elements 326, 327 is preferably greater than 0.5 mm or 1 mm and/or smaller than 5 mm or 3 mm, preferably about 2 mm. Particularly preferably, all gaps between two adjacent spring elements 326, 327, in the shown exemplary embodiment all eight gaps, have the same size or dimensions.

Preferably, the distance between two oppositely arranged spring elements 326, 327 and/or the inner diameter of the ring-like structure formed by the spring elements 326, 327 is (slightly) smaller than the outer diameter of the holder head 121 or wall 121' and/or less than 40 mm or 33 mm and/or more than 25 mm, particularly preferably about 30.5 mm.

The spring elements 326, 327 are preferably resilient or elastic, in particular in radial direction (with respect to axis $M_{WZ}$) and/or can flex apart, in particular such that the distance between oppositely arranged spring elements 326, 327 or the diameter of the circle formed by the free ends 326', 328', 329' is (slightly) increased.

Preferably, the outer diameter of the ring-like structure formed by the spring elements 326, 327 corresponds at least essentially to the the diameter of the collar 122 and/or the outer diameter of the annular rim 123, and/or is more than 30 mm or 35 mm and/or less than 50 mm or 45 mm, in particular about 40.5 mm.

The spring elements 326 are preferably substantially cuboidal in shape.

Preferably, the spring elements 326 are curved and/or formed as a ring segment.

The height of the spring element 326 or extension of the spring elements 326 in axial direction (with respect to axis $M_{WZ}$) is preferably more than 5 mm or 8 mm and/or less than 20 mm or 15 mm, particularly preferably about 12 mm.

Preferably, an internal chamfer 326*a* is formed at the free ends 326' of the spring elements 326 and a lateral chamfer 326*b* is formed at one side.

The internal chamfer 326*a* is preferably formed at the edge of the free end 326' facing (radially) inwards, i.e., facing towards the axis $M_{WZ}$ and/or towards an oppositely arranged spring element 326.

The lateral chamfer 326*b* is preferably formed at one of the edges of the free end 326' facing in circumferential direction (with respect to the the axis $M_{WZ}$) or to the side or towards an adjacent spring element 327. Preferably, the other edge of the free end 326' facing in circumferential direction or to the side or to another adjacent spring element 327 is not chamfered.

Preferably, in contrast to the spring elements 326, the spring elements 327 have receiving openings 327', whereby two legs 328, 329 with free ends 328', 329' as well as narrow regions 327" are formed.

The spring elements 327 are preferably fork-like and/or at least essentially U-shaped.

The spring elements 327, in particular the legs 328, 329, are preferably curved.

The receiving openings 327' are preferably formed between two legs 328, 329, respectively, in particular in circumferential direction (with respect to the the axis $M_{WZ}$).

The receiving openings 327' or their narrow regions 327" face in particular in axial direction and/or away from the base body 321 or base plate 322 or intermediate layer 320 or polishing foil 340 and/or, during processing, away from the optical workpiece 9 and/or towards the tool holder 120, in particular the retaining elements 124, or tool spindle 30, 30'.

Preferably, in the narrow regions 327", the distance between the two legs 328, 329 is smaller or the gap formed therebetween is narrower compared to the distance or gap between the legs 328, 329 further into the receiving openings 327'. In other words, the receiving opening 327' is preferably undercut.

In the wider region, the distance or gap between the legs 328, 329 or the width of the receiving opening 327' is preferably (slightly) larger than the diameter of the head 124*a* of the retaining element 124, and/or larger than 3 mm or 5 mm and/or smaller than 7 mm, particularly preferably about 5.2 mm.

The smallest distance or gap between the legs 328, 329 or the smallest width of the receiving opening 327', in particular in the narrow region 327", is preferably (slightly) smaller than the diameter of the head 124*a* of the retaining element 124, and/or smaller than 7 mm or 5 mm and/or larger than 3 mm, particularly preferably about 4.7 mm.

The legs 328, 329 are preferably resilient or elastic, in particular in circumferential direction (with respect to axis $M_{WZ}$) and/or can flex apart, in particular such that the distance between the legs 328, 329 or the width of the receiving opening 327', in particular in the narrow region 327", is (slightly) increased.

Preferably, the legs 328, 329 have a different shape or form.

Preferably, the legs 328 have the same height as the spring elements 326 and/or are also provided with an internal chamfer 328*a*.

The internal chamfer 328*a* is preferably formed at the edge of the free end 328' facing (radially) inwards, i.e., facing towards the axis $M_{WZ}$ and/or towards an oppositely arranged spring element 327.

The height of the leg 328 is preferably greater than the height of the receiving opening 327' and/or the distance between the narrow region 327" and the base of the receiving opening 327'.

The side 328*b* of the leg 328 facing towards the leg 329 is preferably inclined or beveled, in particular in the region of the free end 328', preferably between the narrow region 327" and the free end 328'.

The inclination of the side 328*b* with respect to the axial direction or axis $M_{WZ}$ is preferably more than 15° or 20° and/or less than 25° or 30°, particularly preferably about 22°.

Preferably, the leg 329 has a lower height than the spring element 326 or leg 328 and/or is formed essentially as a cuboid frustum, preferably wherein all four edges 329" of the cuboid frustum have a different height.

The (maximum) height of the leg 329 is preferably more than 6 mm or 7 mm and/or less than 12 mm or 11 mm, particularly preferably about 9 mm or 9.5 mm. However, since the edges 329" can have different heights, certain sides of the leg 329 can have a smaller height.

Preferably, the height of the edge 329" facing away from the receiving opening 327' or leg 328 and/or facing towards an adjacent spring element 326 is greater than the height of the opposite edge 329", i.e., the edge facing towards the receiving opening 327' or leg 328.

Preferably, the free end 329' of the leg 329 is inclined or beveled, in particular towards the receiving opening 327'.

The inclination of the free end 329' with respect to the axial direction or axis $M_{WZ}$ is preferably more than 50° or 60° and/or less than 80°, particularly preferably about 68°.

Particularly preferably, the angle between the inclined side 328*b* of the leg 328 and the free end 329' is about 90°.

FIG. 2A further shows that the lateral chamfer 326*b* of each spring element 326 is arranged adjacent to a leg 329 of the spring element 327.

Particularly preferably, as can be seen from FIG. 2A, the lateral chamfer 326*b* and the free end 329' have the same inclination or enclose the same angle with the axis $M_{WZ}$. In particular, the lateral chamfer 326*b* and the free end 329' form a flat (inclined) surface which is interrupted or disconnected due to the gap between the spring elements 326, 327.

The connection of the recess 323*b* in the workpiece-side base surface 323*a* of the base plate 322 of the base body 321 to the intermediate layer 330 is designed in such a way that the torque of the tool spindle 30, 30' can be transmitted from the base body 321 to the intermediate layer 330.

In the illustrated exemplary embodiment, the recess 323*b* and the intermediate layer 330 are adhesively bonded together.

The diameter of the intermediate layer 330 in the exemplary embodiment is between 35 mm and 60 mm.

In the following, a particularly preferred design of the intermediate layer 330 is explained in more detail.

The intermediate layer 330 is preferably formed in two parts.

A first part 331 is directly (adhesively) bonded to the recess 323*b* of the base plate 322. A second part 332 is directly (adhesively) bonded to the first part 331.

The polishing foil 340 is directly (adhesively) bonded to the second part 332.

In the exemplary embodiment, both parts are made of a polyurethane foam (PUR foam), wherein the first part 331 preferably consists of a closed-cell PUR foam, while the second part 332 preferably consists of a mixed-cell PUR foam, in order to reduce the influence of the polishing agent on the material properties of the second part 332. Other configurations of the foams and/or other materials for the intermediate layer 330 are of course conceivable.

The first part 331 of the intermediate layer 330 has a higher static modulus of elasticity than the second part 332 of the intermediate layer 330, by a factor of at least 1.2; however, an increase by a factor of 1.5 or 2 is also possible. Accordingly, the first part 331 of the intermediate layer 330 is harder than the second part 332 of the intermediate layer 330.

In the exemplary embodiment, the static modulus of elasticity of the first part 331 is more than 0.4 N/mm$^2$ but less than 2 N/mm$^2$. Good results are achieved with a static modulus of elasticity between 0.75 and 1.75 N/mm$^2$.

In the exemplary embodiment, the static modulus of elasticity of the second part 332 is more than 0.05 N/mm$^2$ but less than 1 N/mm$^2$. Good results are achieved with a static modulus of elasticity between 0.075 and 0.9 N/mm$^2$ as well as between 0.1 and 0.6 N/mm$^2$.

The modulus of elasticity is preferably a material characteristic value for the relationship between stress and strain and/or pressure and compression when a (test) piece made of this material is deformed.

A material with a low modulus of elasticity is softer and/or more elastic and/or easier to compress than a material with a higher modulus of elasticity.

The terms "hard" and/or "soft" are to be understood as a material property which can be used as a measure of the force or pressure required to compress or squeeze the material by a certain length value.

In other words, the "hardness" and/or "softness" and/or "stiffness" is the mechanical resistance that a material and/or substance has against (elastic) deformation/compression.

A hard material is preferably less elastic and/or less easy to compress than a soft material.

The term "elasticity" and/or "elastic" in the sense of the present disclosure is preferably understood to mean the property of a material to change its shape elastically, i.e. not plastically, under the action of force and to return to its original shape—without permanent deformation—when the acting force is removed.

To determine the (static) modulus of elasticity, a predefined pressure is preferably applied to a surface of a cuboidal, in particular a cube-shaped, test piece and the compression of the test piece in the direction of pressure/force is measured.

The modulus of elasticity is preferably the quotient of pressure in [N/mm$^2$] and compression in [mm] multiplied by the original length/width in [mm] of the test piece in the direction of pressure/force.

Preferably, the above values for the modulus of elasticity refer to a test piece in which the ratio of the pressurized surface to the lateral surface (shape factor/form factor) is three and to which a pressure of 0.01 N/mm$^2$ or 0.035 N/mm$^2$ or 0.055 N/mm$^2$ or 0.1 N/mm$^2$ or 0.2 N/mm$^2$ is applied.

Accordingly, the first part 331 of the intermediate layer 330 has a greater compression hardness than the second part 332 of the intermediate layer 330, by at least a factor of 2; however, an increase by a factor of 3 or 4 is also possible.

In the exemplary embodiment, the compression hardness of the first part 331 is between 0.05 and 0.3 N/mm$^2$. Good results are achieved with a compression hardness between 0.12 and 0.2 N/mm$^2$, in particular 0.15 N/mm$^2$.

In the exemplary embodiment, the compression hardness of the second part 332 is between 0.01 and 0.1 N/mm$^2$. Good results are achieved with a compression hardness between 0.02 and 0.08 N/mm$^2$, in particular with compression hardnesses of 0.031 and 0.047 N/mm$^2$.

The compression hardness is preferably a material characteristic value that indicates the pressure required to compress a test piece and/or the respective part 331, 332 by a certain amount, preferably by 10% or 40% of its original thickness.

The above values for the compression hardness preferably refer to a cuboidal, in particular a cube-shaped, test piece in which the ratio of the pressurized surface to the lateral surface (shape factor/form factor) is three and which has been compressed by 10% relative to its original size.

The compression hardness is preferably determined in accordance with DIN EN ISO 3386, preferably ISO 3386-1:1986.

The first, harder part 331 of the intermediate layer 330 is formed significantly thicker than the second, softer part 332 of the intermediate layer 330 to enable precise polishing and to reduce the center offset of the processing tool 320 during the polishing process.

The first part 331 is at least a factor of 1, but at most a factor of 3 thicker than the second part 332 of the intermediate layer 330. Good results are achieved with a thickness of the first part 331 between 10 and 14 mm and a thickness of the second part 332 between 6 and 9 mm.

The total thickness of the intermediate layer 330 should not exceed 22 mm.

Preferably, the polishing foil 340 is made of a polyurethane material and has a larger diameter than the intermediate layer 330, so that it protrudes over the edges of the intermediate layer 330.

In the exemplary embodiment, the polishing foil 340 further has a thickness of 0.08 to 2 mm, wherein good results are achieved with a thickness of 1.2 mm.

The radius of curvature of the polishing foil 340 or its polishing surface 341 is typically larger than the radius of curvature of the recess 323*b*, typically by at least 100 mm. This depends, in a manner known per se, on the thickness of the intermediate layer 330 as well as the material properties of intermediate layer 330 and polishing foil 340.

Compared to the prior art, larger radii of curvature of the recess 323*b* and/or polishing surface 341 have proven useful in order to be able to polish larger processing areas of the lenses and/or increase the amount of material removed during polishing.

According to the disclosure, a manual change of the processing tool 320 should be easy and safe to perform, on the other hand, the processing tool 320 with its base body 321 should be firmly held on the tool holder 120 in such a way that it does not detach from the tool holder 120 during the processing operation, in particular the polishing process.

Surprisingly, it has now been found that the preferred dimensions (in millimeters) of the processing tool 320, in particular as described above, in interaction with the preferred dimensions of the tool holder 120 (see above), may contribute substantially to meeting these two opposing requirements particularly well. This is to the extent that no additional components are required to secure the processing tool 320 on the tool holder 120, so that a change of the processing tool 320 by an operator can also be performed single-handedly.

The preferred dimensions of the processing tool 320—in interaction with the preferred dimensions of the tool holder 120 (see above)—further have the effect that an operator can carry out a change of the processing tool 320 quickly and safely even without a direct view of the tool holder 120 and/or in the case of limited accessibility of the tool holder 120, which is fixed on the spindle head 310 of the tool spindle 30, 30'.

Figure 3:
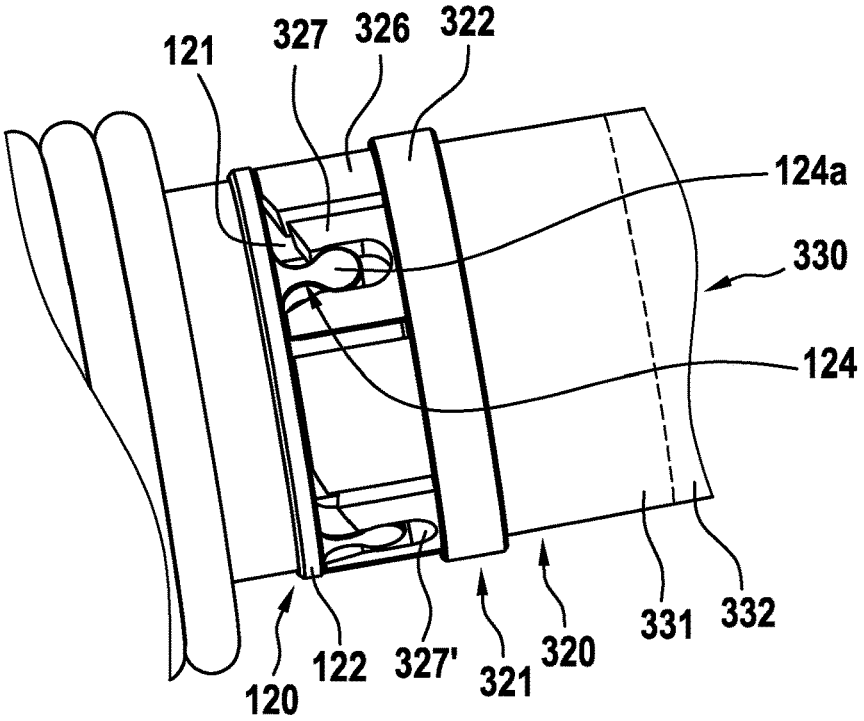
FIG. 3 an enlarged view of the processing tool connected to the tool holder according to FIG. 2A.

The connection of the processing tool 320 to the tool holder 120 is shown enlarged in FIG. 3.

Preferably, when the processing tool 320 is connected to the tool holder 120, the center axes $M_{TH}$, $M_{WZ}$ of the tool holder 120 and processing tool 320 coincide and/or the tool holder 120 and processing tool 320 are arranged concentrically to each other.

A torque can be transmitted from the tool spindle 30, 30' to the processing tool 320 via the tool holder 120 and/or the spindle disk 133.

The connection of the processing tool 320 to the tool holder 120 is reversible, so that the change of the processing tool 320 in the event of wear or damage can be carried out manually in a simple manner.

As can be seen from FIG. 3, the spring elements 326, 327 of the receiving region of the base body 321 are pushed onto the annular holder head 121 of the tool holder 120 in such a way that the free ends 326' of the spring elements 326 and the free ends 328' of the legs 328 abut on the collar 122 or annular rim 123 of the tool holder 120.

Preferably, the holder head 121 or its wall 121' is clamped between the spring elements 326, 327, in particular in radial direction. This is in particular achieved by the spring elements 326, 327 flexing apart due to the outer diameter of the holder head 121 or its wall 121' being (slightly) larger than the distance of opposite spring elements 326, 327 or inner diameter of the ring-like structure formed by the spring elements 326, 327.

Preferably, the processing tool 320, in particular the spring elements 326, 327, is biased or pretensioned against the tool holder 120, in particular the holder head 121 or wall 121', in particular in axial direction.

Preferably, for removing the processing tool 320 from the tool holder 120, the frictional force between the processing tool 320, in particular the spring elements 326, 327, and the tool holder 120, in particular the holder head 121 or wall 121', must be overcome by an appropriate axial force.

Pushing the processing tool 320 onto the tool holder 120 and/or flexing of the spring elements 326, 327 is preferably facilitated or supported by means of the internal chamfers 326*a*, 328*a*.

In the case of the spring elements 326, 327 abutting the collar 122 or annular rim 123, the legs 328, 329 of each spring element 327 each enclose a retaining element 124 of the tool holder 120. The narrow regions 327" formed by the receiving openings 327' lie in this case behind the head 124*a* of each retaining element 124, in such a way that the base body 321 is held in a clamping manner.

Preferably, the retaining elements 124, in particular their heads 124*a*, are clamped between the respective legs 328, 329, in particular in circumferential direction. This is in particular achieved by the legs 328, 329 flexing apart due to the diameter of the heads 124*a* being (slightly) larger than the smallest distance between the legs 328, 329 or the smallest width of the receiving opening 327', in particular in the narrow region 327".

Preferably, the processing tool 320, in particular the legs 328, 329, is biased or pretensioned against the tool holder 120, in particular the retaining elements 124 or heads 124*a*, in particular in axial direction.

Preferably, for removing the processing tool 320 from the tool holder 120, the frictional force between the processing tool 320, in particular the legs 328, 329, and the tool holder 120, in particular the retaining elements 124 or heads 124*a*, must be overcome by an appropriate axial force.

The processing tool 320 is preferably held on the tool holder 120 by means of the clamping or form-fit or latching connection between the holder head 121 or its wall 121' and the spring elements 326, 327, on the one hand, and between the retaining elements 124 or their heads 124*a* and the legs 328, 329, on the other hand.

Preferably, the processing tool 320 is fixed on the tool holder 120 in radial and circumferential direction by form-fit and in the axial direction at least by force-fit, preferably also by form-fit due to the undercut of the receiving opening 327' and/or retaining element 124.

In particular, the processing tool 320 is securely held/fixed on the tool holder 120 during processing, even in the case of high rotational speed.

Furthermore, it can be seen from FIG. 3 that the heads 124*a* of the retaining elements 124 do not completely fill the receiving openings 327'. This has the advantage that greater variations in the manufacturing tolerances are acceptable when manufacturing the base body 321, for example by means of injection molding, so that the base body 321 of the processing tool 320 can be regarded as a mass-produced article that can be manufactured inexpensively.

The tool holder 120 is characterized in particular in that a processing tool 320 is rigidly held, i.e. any moving and/or elastic parts between the tool holder 120 and the processing tool 320, such as in particular a ball head, rubber-elastic parts or flexure bearings, are dispensed with. In other words, the necessary deflection of the processing tool 320 during the processing operation, in particular the polishing process, takes place exclusively by means of the two-part elastic intermediate layer 330.

Thus, the processing tool 320 can be controlled and/or guided much more precisely during the processing operation than is known in the prior art.

The tool holder 120 is further characterized in that it is firmly mounted on the spindle head of the polishing spindle and only the processing tool 320 itself is manually exchanged in the event of wear or damage.

The preferred design of the spring elements 326, 327 has the effect that an operator can fit or plug the base body 321 of the processing tool 320 onto a tool holder 120 without requiring a free field of view for this purpose.

For this purpose, the base body 321 is pushed onto the annular holder head 121 until resistance is felt (because, for example, the free ends of the spring elements 326, 327 rest or abut on the retaining elements 124). Then the base body 321 is rotated clockwise on the holder head 121 until resistance is again felt. In this position, the retaining elements 124 rest against the chamfered free ends 328' or inclined sides 328*b* of the longer legs 328 so that clockwise movement is blocked. Now the operator knows that the retaining elements 124 are positioned opposite the receiving openings 327' corresponding thereto. The base body 321 is now in the correct position on the annular holder head 121 and can now be pushed on, as shown in FIG. 3.

Preferably, the lateral chamfers 326*b* of the spring elements 326 and/or inclined free ends 329' of the spring elements 327, in particular their legs 329, facilitate or support the above described mounting process. In particular, the lateral chamfers 326*b* and/or inclined free ends 329' form lead-in chamfers which lead or guide the retaining element 124 towards the receiving opening 327'.

Particularly preferably, once the retaining elements 124 or heads 124*a* abut the lateral chamfers 326*b* or inclined free ends 329', the operator just needs to push in axial direction which in turn causes a desired rotational movement for positioning the retaining elements 124 opposite the receiving openings 327'.

Of course, the processing tool 320 can be adapted for a mounting process in which the processing tool 320 is rotated counter-clockwise, in particular with correspondingly changed or mirrored inclined surfaces. It is also possible to provide lead-in chamfers on both sides of the receiving openings 327' such that the operator can rotate the processing tool 320 in either direction.

As a result, a structurally simple, stable and, according to the disclosure, joint-free and/or rigid connection of the tool 320 via the tool holder 120 to the spindle head 310 of each tool spindle 30, 30' is obtained. Furthermore, the processing tool 320 can be mounted or plugged on the tool holder 120 in a simple manner and can be removed or pulled off again when changing tools.

According to a particularly preferred aspect of the present disclosure, the following polishing process can be carried out in combination with the tool holder 120 and the processing tool 320 (cf. FIGS. 4A to 5):

The processing tool 320 and/or the polishing foil 340 has a tool axis which forms a center axis $M_{WZ}$ and/or rotation axis $R_{WZ}$. Typically, the tool axis corresponds to the center axis or rotation axis of the tool holder 120 and/or the tool spindle 30, 30', and, at least initially as shown in FIGS. 4A and 4B, the center axis Mw of the workpiece 9 or respective workpiece spindles.

In an exemplary embodiment of a polishing method, the radius of curvature of the polishing surface 341 of the polishing foil 340 is larger than the largest radius of curvature of the optical workpiece 9 to cause an annular contact surface when the processing tool 320 is pressed against the optical workpiece 9. In this way, the removal rate can be increased compared to point contact surfaces and/or when the radius of curvature of the polishing surface 341 is smaller.

During the polishing process, the polishing surface 341 of the polishing foil 340 and the optical surface of the optical workpiece 9 to be polished are in direct contact with each other. Here, the polishing surface 341 lies with its entire surface on the optical surface.

The polishing pressure is kept constant during the polishing process within a tolerance range and is between 0.01 and 0.1 $N/mm^2$.

The diameter of the optical workpieces 9 to be polished is typically larger than the diameter of the polishing foil 340.

During the polishing process, the rotational speed of the polishing tool 320 or the tool spindles 30, 30' is typically greater than the rotational speed of the workpiece 9 or workpiece spindles holding the workpiece 9 by a factor of 1, 5 or 2, wherein the rotational speed of the tool spindles 30, 30' is 1,500 rpm or 2,000 rpm.

Figure 5:
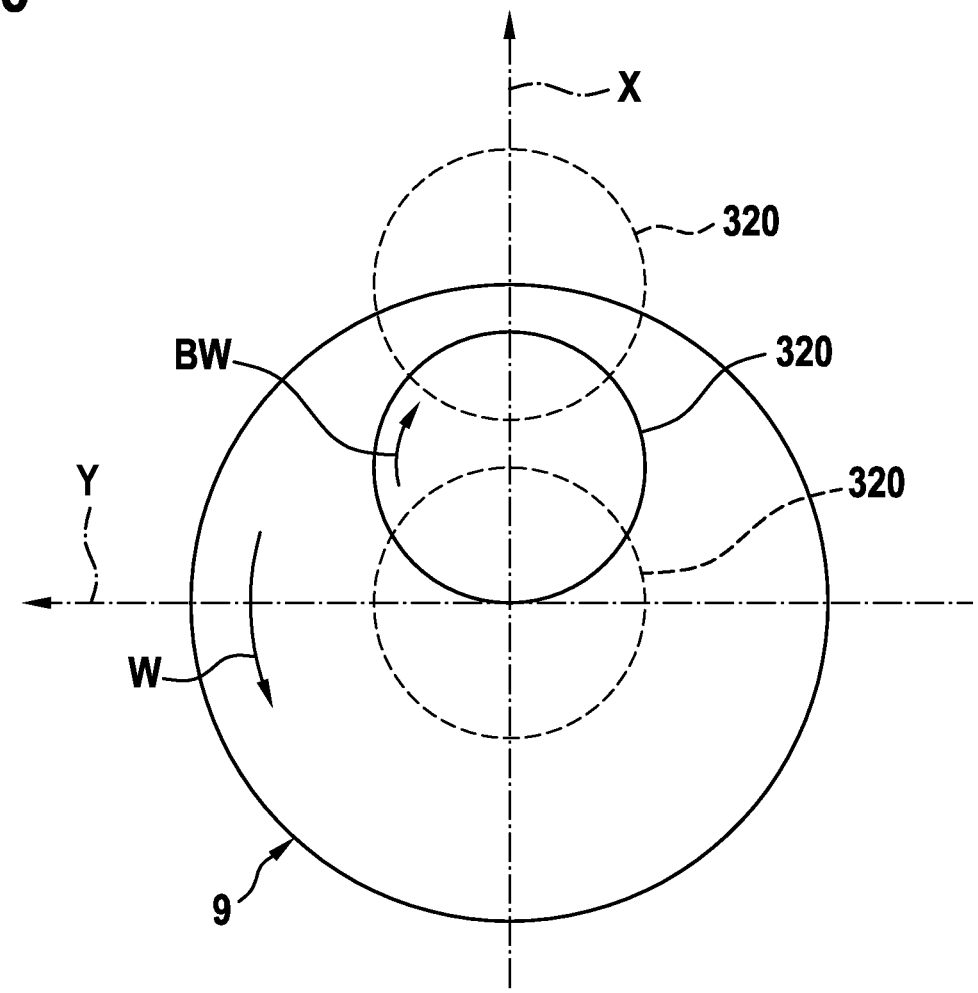
FIG. 5 the processing positions of the processing tool relative to the workpiece in a plan view.

In this process, the optical workpiece 9 typically rotates in the direction of the arrow W in the opposite direction to the processing tool 320, which rotates in the direction of the arrow BW (cf. FIG. 5).

The duration of the polishing process is typically between 30 and 120 seconds.

During the polishing process, the two-part intermediate layer 330 of the processing tool 320 is compressed, wherein the second, softer part 332 is more compressed than the first, harder part 331. Typically, the intermediate layer 330 is compressed by 5 to 80%, wherein good results are achieved with a compression of between 10 and 25%. The above values refer to the original thickness of the intermediate layer 330.

Furthermore, the polishing foil 340 can yield or give way in radial direction, i.e. transversely to the center axis $M_{WZ}$ of the processing tool 320 or tool spindles 30, 30', in order to enable adaptation to radii of curvature of the surface to be polished of the optical workpiece 9 changing in circumferential direction. This is the case, for example, with toric surfaces.

For example, a smaller radius of curvature may cause the intermediate layer 330 to be more compressed in a deflected or off-center processing position at the edge of the optical workpiece 9 than in the center of the optical workpiece 9. This causes the center axis of the tool holder 120 or tool spindle 30, 30' to be tilted relative to the center axis $M_{WZ}$ of the processing tool 320 and/or creates a center offset.

Due to the joint-free and/or rigid structure of the tool holder 120 and/or of the connection between the tool holder 120 and the processing tool 320, the deflection and/or center offset of the processing tool 320 occurs solely by means of the two-part intermediate layer 330. This, in combination with the structure of the intermediate layer 330 with a harder or first part 331 and a softer or second part 332, has the effect that the processing tool 320 and/or the center axis $M_{WZ}$ of the processing tool 320 can be moved up to or over the edge of the optical workpiece 9 without the polishing foil 340 lifting off from the optical surface of the optical workpiece 9 to be polished.

Known apparatuses with an articulated or joint connection of the processing tool to the tool spindle (for example, with a ball-and-socket joint or a flexure bearing), in contrast, would tilt in a processing position in which the center axis of the processing tool is moved over the edge of the optical workpiece 9 in such a way that the polishing foil of the processing tool loses contact with the optical surface of the optical workpiece to be polished.

With the processing tool 320, it is thus possible to perform a surface polishing and/or a polishing with a high removal rate even in the edge area of the optical workpiece 9 continuously and with the required accuracy.

The polishing process according to the disclosure results in a longer service life of the processing tools 320. Optimally, the processing tool 320 is changed approximately every 4 hours or approximately every 15,000 seconds.

Individual aspects and features of the present disclosure can be implemented independently from each other, but also in any combination.

The present disclosure relates in particular to any one of the following aspects which can be realized independently or in any combination, also in any combination with any aspects above:

1. Tool holder (120) for a processing tool (320) for processing optical workpieces (9), having a holder head (121) for receiving a processing tool (320) and a holder body (126) for fastening the tool holder (120) to a tool spindle (30, 30'),
   characterized
   in that the holder head (121) is annular with an annular rim (123) and that at least two retaining elements (124) are arranged on the annular rim (123).

2. Tool holder according to aspect 1, characterized in that the retaining elements (124) are in the form of retaining lugs with a head (124*a*).

3. Tool holder according to aspect 1 or 2, characterized in that three or four retaining elements (124) are arranged on the annular rim (123).

4. Tool holder according to one of the preceding aspects, characterized in that the holding elements (124) are arranged rotationally symmetrically on the annular rim (123).

5. Tool holder according to one of the preceding aspects, characterized in that a bellows (127) is attached to the holder body, to the free end (127") of which a spindle flange (130) is attached.

6. Tool holder according to aspect 5, characterized in that the spindle flange (130) has a collar (131) to which the free end (127") of the bellows (127) is attached, and a spindle disk (133) for attaching the spindle flange (130) to a tool spindle (30, 30').

7. Tool holder according to aspect 6, characterized in that the spindle disk (133) has at least two recesses (134) in which spring elements (135) are arranged.

8. Tool holder according to aspect 7, characterized in that the spindle disk (133) has three or four recesses (134).

9. Tool holder according to aspect 7 or 8, characterized in that the recesses (134) are arranged rotationally symmetrically in the spindle disk (133).

10. Processing tool (320) for processing optical workpieces (9), having a base body (321), an elastic intermediate layer (330) and a polishing film (340),
   characterized
   in that spring elements (326, 327) are provided on the base body (321), the spring elements (327) having legs (328, 329) which enclose a receiving opening (327').

11. Tool spindle (30, 30') having a spindle head (310),
   characterized
   in that the spindle head (310) has at least two bolts (312).

12. Tool spindle according to aspect 11, characterized in that a tool holder (120) according to one of the aspects 6 to 9 is fastened to the spindle head (310) by holding the at least two bolts (312) in the at least two receiving openings (134) in a form-fitting manner.

13. Tool spindle according to aspect 12, characterized in that a processing tool (320) according to aspect 10 is attached to the tool holder (120).

14. Tool spindle according to aspect 13, characterized in that the spring elements (326, 327) are pushed onto the annular holder head (121) of the tool holder (120), that the heads (124*a*) of the retaining elements (124) are held in the receiving openings (327') of the spring elements (327) in a form-fit manner.

15. Method for processing optical workpieces (9), using a tool spindle (30, 30'; 31, 31') to which a tool holder (120) is fastened, on which a processing tool (320) is received,
   characterized
   in that the processing tool (320) comprises a base body (321), an elastic intermediate layer (330) and a polishing foil (340),
   in that the intermediate layer (330) has a harder first part (331) at the base body (321) and a softer second part (332) at the polishing foil (340),
   in that the processing tool (320) is rigidly received on the tool holder (120).

List of reference signs:

| | |
|---|---|
| 30, 30' | Tool spindle pair |
| 120 | Tool holder |
| 121 | Annular holder head |
| 121' | Outer wall of 121 |
| 122 | Collar |
| 123 | Annular rim |
| 124 | Retaining element |
| 124a | Head from 124 |
| 124b | Thinned portion of 124 |
| 125 | Cylindrical extension |
| 126 | Annular holder body |
| 127 | Bellows |
| 127' | First free end of the bellows |
| 127" | Second free end of the bellows |
| 127a | Inner circumferential bead |
| 128 | Clamp |
| 129 | Disk |
| 129a | Annular spring |
| 130 | Spindle flange |
| 131 | Collar |
| 132 | Annular circumferential indentation |
| 133 | Spindle disk |
| 134 | Recesses |
| 135 | Spring element |
| 135' | Free end of the spring element |
| 310 | Spindle head |
| 311 | Bellows |
| 312 | Bolt |
| 312a | Bolt head |
| 312b | Annular recess |
| 313 | Spindle shaft |
| 314 | Lifting rod |
| 315 | Cap |
| 315a | Free surface of 315 |
| 316 | Lifting cylinder |
| 320 | Processing tool |
| 321 | Base body |
| 322 | Base plate |
| 323a | Workpiece-side base surface |
| 323b | Recess |
| 324a | Spindle side base surface |
| 324b | Recess |
| 325 | RFID chip |
| 326 | Spring element (cuboid-shaped) |
| 326' | Free end of 326 |

-continued

| List of reference signs: | |
|---|---|
| 326a | Internal chamfer of 326 |
| 326b | Lateral chamfer of 326 |
| 327 | Spring element |
| 327' | Receiving opening |
| 327" | Narrow region |
| 328 | Longer leg |
| 328' | Free end of 328 |
| 328a | Internal chamfer of 328 |
| 328b | Inclined side of 328 |
| 329 | Shorter leg |
| 329' | Free end of 329 |
| 329" | Edges from 329 |
| 330 | Intermediate layer |
| 331 | First part of 330 |
| 332 | Second part of 330 |
| 340 | Polishing foil |
| 341 | Polishing surface |
| BW | Direction of rotation (tool) |
| H | Oscillation stroke |
| $M_{TH}$ | Center axis of tool holder |
| $M_W$ | Center axis of workpiece |
| $M_{WZ}$ | Center axis of processing tool |
| $R_W$ | Rotation axis of workpiece |
| $R_{WZ}$ | Rotation axis of processing tool or tool spindle |
| W | Direction of rotation (work-piece) |

The invention claimed is:

1. A processing tool configured to polish optical workpieces comprising:

a base body having a longitudinal axis central to an outer circumferential surface, an elastic intermediate layer;

a polishing layer or foil, and a plurality of spring elements, each of the plurality of spring elements including a pair of legs, each pair of legs forming a segment of the outer circumferential surface of the base body, each pair of legs partially enclosing a receiving opening, the receiving opening open along the longitudinal axis of the base body, facing away from the base body, and configured to receive a head of a receiving element, and wherein each leg in each of the pairs of legs are respectively adapted to flex apart from one another along a circumferential direction of the outer circumferential surface of the base body.

2. A system comprising:

a tool holder for a processing tool; and a processing tool configured to polish optical workpieces, the processing tool being connected or connectable to the tool holder, the tool holder comprising a holder head receiving the processing tool, and a holder body configured to fasten the tool holder to a tool spindle, the holder head being annular with an annular rim and at least two retaining elements being arranged on the annular rim, the processing tool comprising a base body, an elastic intermediate layer, and a polishing layer or foil, and the base body having a longitudinal axis central to an outer circumferential surface and comprising a plurality of spring elements and a plurality of receiving openings, wherein the plurality of spring elements are provided along the outer circumferential surface, each spring element of the plurality of spring elements having legs which enclose one respective receiving opening of the plurality of receiving openings, each leg forming a segment of the outer circumferential surface of the base body, the legs being respectively adapted to flex apart from one another along a circumferential direction of the outer circumferential surface of the base body.

3. The system according to 2, wherein each retaining element has a head and a portion which has a smaller width than the head in a direction which is tangential to a circumference of the tool holder.

4. The system according to 2, wherein the holder head comprises an annular outer wall, wherein the retaining elements extend along the outer wall.

5. The system according to 2, wherein the holder head is connected or connectable reversibly in a form-fitting or latching manner to the processing tool by the retaining elements.

6. The system according to 2, wherein each retaining element or a head thereof is received or clamped between a respective pair of legs formed by the legs of the spring elements.

7. The system according to 2, wherein the processing tool is held on the tool holder in such a way that the spring elements of the processing tool are pushed onto the annular holder head, so that heads of the retaining elements are held in form-fitting or latching manner in the receiving openings of the spring elements.

8. The system according to 2, wherein the spring elements of the processing tool are pushed onto the annular holder head in such a way that their free ends abut on the annular rim or a collar of the tool holder.

9. The system according to 2, wherein a pair of legs of one spring element of the processing tool encloses one retaining element of the at least two retaining elements in such a way that the base body of the processing tool is held in a clamping manner.

10. The system according to 2, wherein the retaining elements are retaining lugs with a head.

11. The system according to 2, wherein three or four retaining elements are arranged on the annular rim.

12. The system according to 2, wherein the retaining elements are arranged rotationally symmetrically on the annular rim.

13. The system according to 2, wherein a bellows is attached to the holder body, wherein a spindle flange is attached to a free end of the bellows.

14. A processing tool configured to polish optical workpieces comprising:

a base body having a longitudinal axis central to an outer circumferential surface, an elastic intermediate layer; and a polishing layer or foil, wherein the base body comprises a plurality of spring elements and a plurality of receiving openings, each of the plurality of spring elements including a pair of legs, each pair of legs forming a segment of the outer circumferential surface of the base body, each pair of legs partially enclosing a respective one of the plurality of receiving openings, wherein each leg in each of the pairs of legs are respectively adapted to flex apart from one another along a circumferential direction of the outer circumferential surface of the base body.

15. The processing tool according to claim 14, wherein the spring elements have each a first and a second leg.

16. The processing tool according to claim 14, wherein the plurality of spring elements are a second type of spring elements, wherein the processing tool further includes a first type of spring elements different from the second type of spring elements, where only the second type of spring elements include the pairs of legs.

17. The processing tool according to claim 16, wherein the first type of spring elements are substantially cuboidal in shape and/or in ring segments.

18. The processing tool according to claim 16, wherein the first type of spring elements each have a lateral chamfer formed on one side.

19. The processing tool according to claim 16, wherein each of the second type of spring elements have a first leg and a second leg, wherein an axial extension of the first leg is the same as the axial extension of the first type of spring elements, and wherein the second leg has a smaller axial extension than the first leg.

20. The processing tool according to claim 14, wherein the processing tool is configured to be connected to a tool holder such that respective pairs of legs enclose respective retaining elements of the tool holder to hold the base in a clamping manner.

21. The processing tool according to claim 14, wherein the spring elements or their legs are resilient in a radial direction and/or adapted to flex in radial direction and/or protrude in an axial direction.

22. The processing tool according to claim 14, wherein the legs are adapted to flex apart in a direction tangential to the outer circumferential surface of the base body.

23. The processing tool according to claim 14, wherein the receiving openings are undercut in an axial direction.

24. The processing tool according to claim 14, wherein the spring elements, legs and/or receiving openings are distributed on a circle or an annular face of the base body.

25. The processing tool according to claim 14, wherein the spring elements have inclined surfaces forming lead-in chamfers towards the receiving openings.

26. The processing tool according to claim 14, wherein the intermediate layer has a first part facing the base body and a second part facing the polishing foil, wherein the first part is harder than the second part.

* * * * *